US011091290B2

(12) United States Patent
Bortos et al.

(10) Patent No.: US 11,091,290 B2
(45) Date of Patent: Aug. 17, 2021

(54) INTEGRATED PULLING SYSTEM WITH BACK FLAP

(71) Applicant: Kraft Foods R&D, Inc., Deerfield, IL (US)

(72) Inventors: Daniel Bortos, Loerrach (DE); Maciej Pawlak, Birmingham (GB); Alain Kowalewski, Loerrach (DE)

(73) Assignee: KRAFT FOODS SCHWEIZ HOLDING GMBH, Zug (CH)

( * ) Notice: Subject to any disclaimer, the term of this patent is extended or adjusted under 35 U.S.C. 154(b) by 57 days.

(21) Appl. No.: 16/346,089

(22) PCT Filed: Oct. 31, 2017

(86) PCT No.: PCT/US2017/059300
§ 371 (c)(1),
(2) Date: Apr. 29, 2019

(87) PCT Pub. No.: WO2018/085272
PCT Pub. Date: May 11, 2018

(65) Prior Publication Data

US 2019/0256244 A1 Aug. 22, 2019

Related U.S. Application Data

(60) Provisional application No. 62/415,726, filed on Nov. 1, 2016.

(51) Int. Cl.
*B65D 5/50* (2006.01)
*B31B 50/26* (2017.01)
(Continued)

(52) U.S. Cl.
CPC ..... *B65D 5/5028* (2013.01); *B31B 50/26* (2017.08); *B65D 5/52* (2013.01); *B65D 5/5455* (2013.01);
(Continued)

(58) Field of Classification Search
CPC ..... B65D 5/5028; B65D 5/52; B65D 5/724; B65D 5/5455
(Continued)

(56) References Cited

U.S. PATENT DOCUMENTS 1,271,508 A * 7/1918 Hall ..... B42F 17/02 211/51
1,593,532 A 7/1926 Hansen
(Continued)

FOREIGN PATENT DOCUMENTS

AT 280878 4/1970
CN 2687060 Y 3/2005
(Continued)

OTHER PUBLICATIONS

Decision of Refusal; Japanese Application No. 2015-519351; Drafting Date: Apr. 17, 2018; 4 Pages.
(Continued)

*Primary Examiner* — Ernesto A Grano
(74) *Attorney, Agent, or Firm* — Cantor Colburn LLP

(57) ABSTRACT

A package (20) for displaying items (10) includes a carton body (22) having at least a bottom panel (24) and a front panel (32). A resilient member (50) is configured to urge the items (10) towards the front panel (32) of the carton body (22) and an intermediate member (62) is removably placed at a position between the resilient member (50) and the items (10).

15 Claims, 7 Drawing Sheets

(51) Int. Cl.

| | |
|---|---|
| ***B65D 5/72*** | (2006.01) |
| ***B65D 5/52*** | (2006.01) |
| ***B65D 5/54*** | (2006.01) |
| *B31B 120/30* | (2017.01) |
| *B31B 110/35* | (2017.01) |
| *B31B 120/10* | (2017.01) |

(52) U.S. Cl.
CPC ..... *B65D 5/724* (2013.01); *B31B 2110/35* (2017.08); *B31B 2120/10* (2017.08); *B31B 2120/302* (2017.08)

(58) Field of Classification Search
USPC ..... 206/756
See application file for complete search history.

(56) References Cited

U.S. PATENT DOCUMENTS

| | | | | |
|---|---|---|---|---|
| 1,718,572 | A | 6/1929 | Marcuse | |
| 1,959,614 | A | 5/1934 | Coons | |
| 2,185,605 | A | 1/1940 | Murphy et al. | |
| 2,331,035 | A | 10/1943 | Lundstrom | |
| 2,634,855 | A | 4/1953 | Mandel | |
| 2,735,553 | A | 2/1956 | Lehman | |
| 2,774,467 | A | 12/1956 | Michiel | |
| 2,937,742 | A | 5/1960 | Michiel | |
| 3,122,236 | A | 2/1964 | Michiel | |
| 3,166,195 | A * | 1/1965 | Taber | A47F 1/126 211/59.4 |
| 3,202,316 | A | 8/1965 | Silver | |
| 3,373,922 | A | 3/1968 | Watts | |
| 3,423,143 | A | 1/1969 | Bunger | |
| 3,433,546 | A * | 3/1969 | Cohen | B65D 83/00 312/71 |
| 3,591,049 | A | 7/1971 | Auriemma | |
| 3,647,114 | A | 3/1972 | Bleuer | |
| 4,020,946 | A | 5/1977 | Gardner et al. | |
| 4,588,093 | A | 5/1986 | Field | |
| 4,616,767 | A | 10/1986 | Seido | |
| 4,616,787 | A | 10/1986 | Kirsten | |
| 4,844,331 | A | 7/1989 | Oldfather | |
| 5,161,702 | A | 11/1992 | Skalski | |
| 5,197,631 | A | 3/1993 | Mishima | |
| 5,393,291 | A | 2/1995 | Wingerter | |
| 5,507,390 | A | 4/1996 | Vila | |
| 5,988,407 | A | 11/1999 | Battaglia | |
| 5,992,683 | A | 11/1999 | Sigl | |
| 6,015,051 | A | 1/2000 | Battaglia | |
| 6,109,458 | A | 8/2000 | Walsh et al. | |
| 6,193,067 | B1 | 2/2001 | McMahan | |
| 6,227,386 | B1 | 5/2001 | Close | |
| 6,454,107 | B1 * | 9/2002 | Belanger | B65D 5/724 211/59.3 |
| 7,048,464 | B2 | 5/2006 | Ronnquist | |
| 7,284,662 | B2 | 10/2007 | Debusk et al. | |
| 7,481,313 | B1 * | 1/2009 | Kramedjian | B65D 5/5213 206/427 |
| 7,497,342 | B2 | 3/2009 | Hardy | |
| 7,896,172 | B1 | 3/2011 | Hester | |
| 7,997,427 | B2 | 8/2011 | Lowenbraun et al. | |
| 8,646,621 | B2 | 2/2014 | Zacherle et al. | |
| 8,646,650 | B2 * | 2/2014 | Lockwood | G07G 3/003 221/151 |
| 8,939,352 | B2 | 1/2015 | Delause et al. | |
| 8,997,997 | B2 | 4/2015 | Close et al. | |
| 9,889,962 | B2 | 2/2018 | McDonald et al. | |
| 2004/0178157 | A1 | 9/2004 | Tse | |
| 2005/0072747 | A1 | 4/2005 | Roslof et al. | |
| 2005/0161413 | A1 * | 7/2005 | Close | G09F 11/30 211/51 |
| 2007/0108083 | A1 | 5/2007 | Sonon | |
| 2009/0020548 | A1 | 1/2009 | Vandruff | |
| 2011/0294638 | A1 | 12/2011 | Tosevski | |
| 2013/0037562 | A1 | 2/2013 | Close | |
| 2015/0166249 | A1 | 6/2015 | McDonald et al. | |
| 2015/0284134 | A1 * | 10/2015 | Kreutzer | B65D 83/00 221/279 |
| 2016/0296040 | A1 | 10/2016 | McDonald et al. | |
| 2016/0297600 | A1 | 10/2016 | McDonald et al. | |

FOREIGN PATENT DOCUMENTS

| | | | |
|---|---|---|---|
| CN | 2855724 | Y | 1/2007 |
| CN | 1932886 | A | 3/2007 |
| CN | 2882432 | Y | 3/2007 |
| CN | 201026050 | Y | 2/2008 |
| CN | 101484369 | A | 7/2009 |
| CN | 201422663 | Y | 3/2010 |
| CN | 201948530 | U | 8/2011 |
| CN | 202828526 | U | 3/2013 |
| CN | 104768856 | A | 7/2015 |
| CN | 105691810 | A | 6/2016 |
| DE | 1554649 | A1 | 3/1970 |
| DE | 7510538 | U | 8/1975 |
| DE | 8328422 | U1 | 1/1984 |
| DE | 4443775 | A1 | 6/1996 |
| DE | 29908078 | U1 | 10/1999 |
| DE | 10314232 | A1 | 10/2004 |
| DE | 20316963 | U1 | 3/2005 |
| DE | 10352206 | A1 | 6/2005 |
| DE | 102004015701 | B3 | 7/2005 |
| DE | 102004015576 | A1 | 11/2005 |
| DE | 202006007162 | U1 | 12/2006 |
| DE | 102005056162 | A1 | 7/2007 |
| DE | 202007011163 | U1 | 2/2008 |
| DE | 102007034862 | A1 | 1/2009 |
| DE | 102007042764 | A1 | 3/2009 |
| DE | 102010053042 | A1 | 3/2012 |
| EP | 0520885 | A1 | 12/1992 |
| EP | 1462034 | A1 | 9/2004 |
| EP | 2917133 | B1 | 1/2018 |
| FR | 2628357 | A1 | 9/1989 |
| FR | 2646398 | A1 | 11/1990 |
| FR | 2762502 | A1 | 10/1998 |
| GB | 1432723 | | 4/1976 |
| GB | 2407083 | A | 4/2005 |
| GB | 2503677 | A | 1/2014 |
| GB | 2527438 | A | 12/2015 |
| GB | 2530547 | A | 3/2016 |
| JP | 59128272 | U | 8/1984 |
| JP | 63031865 | U | 3/1988 |
| JP | H06255685 | A | 9/1994 |
| JP | H07291372 | A | 11/1995 |
| JP | 09224789 | A | 9/1997 |
| JP | H107129 | A | 1/1998 |
| JP | 2001017281 | A | 1/2001 |
| JP | 3171773 | U | 11/2011 |
| RU | 2243933 | C2 | 1/2005 |
| WO | 9962382 | A1 | 12/1999 |
| WO | 0165981 | A1 | 9/2001 |
| WO | 2010048680 | A1 | 5/2010 |
| WO | 2010109411 | A1 | 9/2010 |
| WO | 2011067488 | A1 | 6/2011 |
| WO | 2014006398 | A2 | 1/2014 |
| WO | 2015071326 | A1 | 5/2015 |
| WO | 2015071327 | A1 | 5/2015 |

OTHER PUBLICATIONS

Examination Report No. 1 for Standard Patent Application; Australian Application No. 2014350253; dated Apr. 20, 2017; 3 Pages.
Examination Report No. 1 for Standard Patent Application; Australian Application No. 2014350254; dated Apr. 13, 2017; 3 Pages.
Examination Report No. 1 for Standard Patent Application; Australian Application No. 2018205164; dated Nov. 26, 2018; 2 Pages.
Examination Report under Section 18(3); Great Britain Application No. 1511610.6; dated Aug. 16, 2016; 2 Pages.
First Office Action and Search Result; Chinese Application No. 201380056883.1; dated Apr. 12, 2016; 19 Pages.
International Search Report (with English Translation); International Application No. PCT/EP2014/074397; International Filing Date: Nov. 12, 2014; dated Jan. 30, 2015; 7 Pages.

(56) References Cited

OTHER PUBLICATIONS

International Search Report (with English Translation); International Application No. PCT/EP2014/074398; International Filing Date: Nov. 12, 2014; dated Jan. 30, 2015; 7 Pages.
International Search Report; International Application No. PCT/GB2013/051755; International Filing Date: Jul. 2, 2013; dated Jan. 28, 2014; 7 Pages.
International Search Report; International Application No. PCT/GB2013/052900; International Filing Date: Nov. 6, 2013; dated Feb. 3, 2014; 3 Pages.
International Search Report; International Application No. PCT/US2017/059300; International Filing Date: Oct. 31, 2017; dated Jan. 23, 2018; 6 Pages.
International Search Report; International Application No. PCT/US2018/032906; International Filing Date: May 16, 2018; dated Jul. 31, 2018; 5 Pages.
Machine Translation of Abstract and Description; German Publication No. 20316963 (U1); Publication Date: Apr. 21, 2005; 17 Pages.
Machine Translation of Abstract; German Publication No. 102004015701 (B3); Publication Date: Jul. 21, 2005; 1 Page.
Machine Translation of Abstract; German Publication No. 102007034862 (A1); Publication Date: Jan. 29, 2009; 1 Page.
Machine Translation of Abstract; German Publication No. 10314232 (A1); Publication Date: Oct. 14, 2004; 1 Page.
Machine Translation of Abstract; German Publication No. 10352206 (A1); Publication Date: Jun. 16, 2005; 1 Page.
Machine Translation of Abstract; German Publication No. 4443775 (A1); Publication Date: Jun. 16, 1996; 1 Page.
Machine Translation of Abstract; International Publication No. 2011067488 (A1); Publication Date: Jun. 9, 2011; 1 Page.
Machine Translation of Abstract; Japanese Publication No. H06255685 (A); Publication Date: Sep. 13, 1994; 1 Page.
Machine Translation of Abstract; Japanese Publication No. H07291372 (A); Publication Date: Nov. 7, 1995; 1 Page.
Machine Translation of Description; German Publication No. 7510538 (U); Publication Date: Aug. 21, 1975; 18 Pages.
Machine Translation; French Publication No. 2762502 (A1); Publication Date: Oct. 30, 1998; 9 Pages.
Machine Translation; German Publication No. 202007011163 (U1); Publication Date: Feb. 14, 2008; 13 Pages.
Notification of the Fourth Office Action and Search Report; Chinese Application No. 201380056883.1; dated Nov. 28, 2017; 15 Pages.
Office Action with Translation; Russian Application No. 2017146618/12(079647); dated Sep. 21, 2018; 6 Pages.
Office Action, Search Result and English Translation; Chinese Application No. 201480062421.5; dated Apr. 2, 2018; 13 Pages.
Office Action, Search Result and English Translation; Chinese Application No. 201480062422.X; dated Feb. 26, 2017; 14 Pages.
Office Action; Canadian Application No. 2,889,476; dated Oct. 12, 2016; 4 Pages.
Office Action; Canadian Application No. 2,889,476; dated Jun. 15, 2017; 3 Pages.
Office Action; European Application No. 13789382.2; dated May 19, 2016; 4 Pages.
Office Action; Russian Application No. 2015112634; dated Sep. 13, 2016; 9 Pages.
Office Action; Russian Application No. 2015112634; dated Feb. 9, 2017; 7 Pages.
Search Report and Written Opinion; Singapore Application No. 11201803448R; Completion Date: Jan. 21, 2019; 8 Pages.
Search Report; German Application No. 202013012351.6; dated Aug. 13, 2018; 5 Pages.
Search Report; German Application No. 202013012359.1; dated Aug. 13, 2018; 5 Pages.
Search Report; Russian Application No. 2015112634; dated Sep. 13, 2016; 2 Pages.
Search Report; Russian Application No. 2017146618/12(079647); dated Sep. 21, 2018; 2 Pages.
Second Office Action; Chinese Application No. 201480062421.5; dated Nov. 27, 2018; 9 Pages.
Second Office Action; Chinese Application No. 201480062422.X; dated Nov. 27, 2018; 9 Pages.
Third Office Action and Search Result; Chinese Application No. 201380056883.1; dated Apr. 12, 2017; 17 Pages.
UK Intellectual Property Office; Application No. GB1219969.1; Further Search Report under Section 17; Date of Searchs: Jul. 23, 2013 and Jul. 24, 2013; 2 Pages.
UK Intellectual Property Office; Application No. GB1219969.1; Search Report under Section 17; Date of Search: Feb. 21, 2013; 2 Pages.
Written Opinion of the International Searching Authority (with English Translation); International Application No. PCT/EP2014/074397; International Filing Date: Nov. 12, 2014; dated Jan. 30, 2015; 12 Pages.
Written Opinion of the International Searching Authority (with English Translation); International Application No. PCT/EP2014/074398; International Filing Date: Nov. 12, 2014; dated Jan. 30, 2015; 10 Pages.
Written Opinion of the International Searching Authority; International Application No. PCT/GB2013/051755; International Filing Date: Jul. 2, 2013; dated Jan. 28, 2014; 10 Pages.
Written Opinion of the International Searching Authority; International Application No. PCT/GB2013/052900; International Filing Date: Nov. 6, 2013; dated Feb. 3, 2014; 7 Pages.
Written Opinion of the International Searching Authority; International Application No. PCT/US2017/059300; International Filing Date: Oct. 31, 2017; dated Jan. 23, 2018; 7 Pages.
Written Opinion of the International Searching Authority; International Application No. PCT/US2018/032906; International Filing Date: May 16, 2018; dated Jul. 31, 2018; 8 Pages.
Australian Examination Report No. 2; International Application No. 2017353625; International Filing Date: May 22, 2019; dated Jul. 28, 2020; 3 pages.
Australian Office Action; Australian Application No. 2017353625; dated Nov. 22, 2019; 3 Pages.
Canadian Office Action; International Application No. 3039614; International Filing Date: Apr. 4, 2019; dated Apr. 9, 2020; 3 pages.
Canadian Office Action; International Application No. 3039614; International Filing Date: Oct. 31, 2017; dated Sep. 9, 2020; 4 pages.
Chinese Office Action; International Application No. 201780061283.2; International Filing Date: Apr. 2, 2019; dated Mar. 23, 2020; 8 pages.
Final Office Action; Product Pusher; U.S. Appl. No. 15/187,941, filed Jun. 21, 2016; Notification Date: Feb. 15, 2019; 18 Pages.
First Office Action and Search Result with English Translation; Chinese Application No. 201810344997.0; dated Jul. 17, 2019; 12 Pages.
Chinese Second Office Action; International Application No. 201780061283.2; International Filing Date: April 2, 2019; dated Nov. 9, 2020; 8 pages.
Notification of the First Office Action with English Translation; Chinese Application No. 202010097258.3 dated Mar. 30, 2021, pp. 1-10.
Notification of Second Office Action with Translation; Chinese Application No. 201880025926.2; dated May 26, 2021; pp. 1-8.

* cited by examiner

INTEGRATED PULLING SYSTEM WITH BACK FLAP

CROSS REFERENCE TO RELATED APPLICATIONS

This application is a National Stage application of PCT/US2017/059300, filed Oct. 31, 2017, which claims the benefit of U.S. Provisional Application No. 62/415,726, filed Nov. 1, 2016, both of which are incorporated by reference in their entirety herein.

FIELD

The disclosure relates generally to a pusher for use in packaging for displaying items of sale.

BACKGROUND OF THE INVENTION

It is known to transport pre-packaged items, such as confectionary, from a manufacturing site to a vending site in bulk cartons, such as cardboard boxes. One of the main functions of such a carton is to protect the items from physical damage during transit. At the vending site, the items are typically removed from the carton and arranged on display for sale.

It may, however, be desirable to display multiple smaller items in a carton and dispense them directly therefrom. In such a case it can be advantageous to use the same carton that was used for transporting the items. Such cartons are often referred to as "shelf ready packs." U.S. Pat. No. 7,284,662 describes a carton that allows a product to be shipped, displayed, and dispensed all from the same carton.

Existing shelf ready packs exhibit a number of problems. For example, items which are stacked in such packs (whether horizontally, vertically or at an inclined angle) can look unsightly after removal of several items. Furthermore, removal of items can result in poor on-shelf presence of the product with the products often hidden from view. To address this problem of on-shelf presence, shelf ready packs having a biasing member for biasing the goods within the pack to a position viewable by a consumer exist. However, in applications where the goods within the pack are relatively fragile or deformable, such as when the goods are an edible food product for example, the biasing force when applied directly to the goods may damage or negatively affect the condition of the goods. It is therefore desirable to have a shelf ready pack which maintains on-shelf presence of the product and allows for the item to be dispensed to the consumer in a controlled manner without altering the condition of the product.

BRIEF DESCRIPTION OF EMBODIMENTS OF THE INVENTION

According to one embodiment of the invention, a package for displaying items includes a carton body having at least a bottom panel and a front panel. A resilient member is configured to urge the items towards the front panel of the carton body and an intermediate member is removably placed at a position between the resilient member and the items.

In addition to one or more of the features described above, or as an alternative, in further embodiments said intermediate member is removed from said position between said resilient member and the items after the items move towards said front panel of said carton body via removal of a desirable number of items from the package.

In addition to one or more of the features described above, or as an alternative, in further embodiments said position between said resilient member and said items is located at a rearmost of said items.

In addition to one or more of the features described above, or as an alternative, in further embodiments said intermediate member is connected to said carton body.

In addition to one or more of the features described above, or as an alternative, in further embodiments said intermediate member extends from said bottom panel of said carton body.

In addition to one or more of the features described above, or as an alternative, in further embodiments said carton body includes a back panel, and said intermediate member extends from at least one of said bottom panel, said back panel, and a junction between said bottom panel and said back panel of said carton body.

In addition to one or more of the features described above, or as an alternative, in further embodiments a fold axis extends across a central portion of said intermediate member, said fold axis defining a contact section and a base section of said intermediate member.

In addition to one or more of the features described above, or as an alternative, in further embodiments when said intermediate member is positioned between said resilient member and the items, said contact section is arranged in contact with the items.

In addition to one or more of the features described above, or as an alternative, in further embodiments as the items are removed from the package, a contact area between said contact section of said intermediate member and the items is reduced.

In addition to one or more of the features described above, or as an alternative, in further embodiments said intermediate member is integrally formed with said carton body.

In addition to one or more of the features described above, or as an alternative, in further embodiments said resilient member is a loop secured at an open end to said front panel and configured to extend around the items.

In addition to one or more of the features described above, or as an alternative, in further embodiments said carton body includes side panels, and said resilient member is a loop secured at an open end to said side panels and configured to extend around the items.

According to another embodiment, a packaging system includes a package having at least a bottom panel and a front panel. A plurality of items is disposed in the package. A resilient member is configured to urge the plurality of items towards the front panel of the package and an intermediate member is removably placed at a position between the resilient member and the plurality of items.

In addition to one or more of the features described above, or as an alternative, in further embodiments said plurality of items is horizontally stacked.

In addition to one or more of the features described above, or as an alternative, in further embodiments said plurality of items is vertically stacked.

These and other embodiments are described in detail below.

BRIEF DESCRIPTION OF THE DRAWINGS

The accompanying drawings incorporated in and forming a part of the specification embodies several aspects of the present disclosure and, together with the description, serves to explain the principles of the present disclosure. In the drawings.

Figure 1:
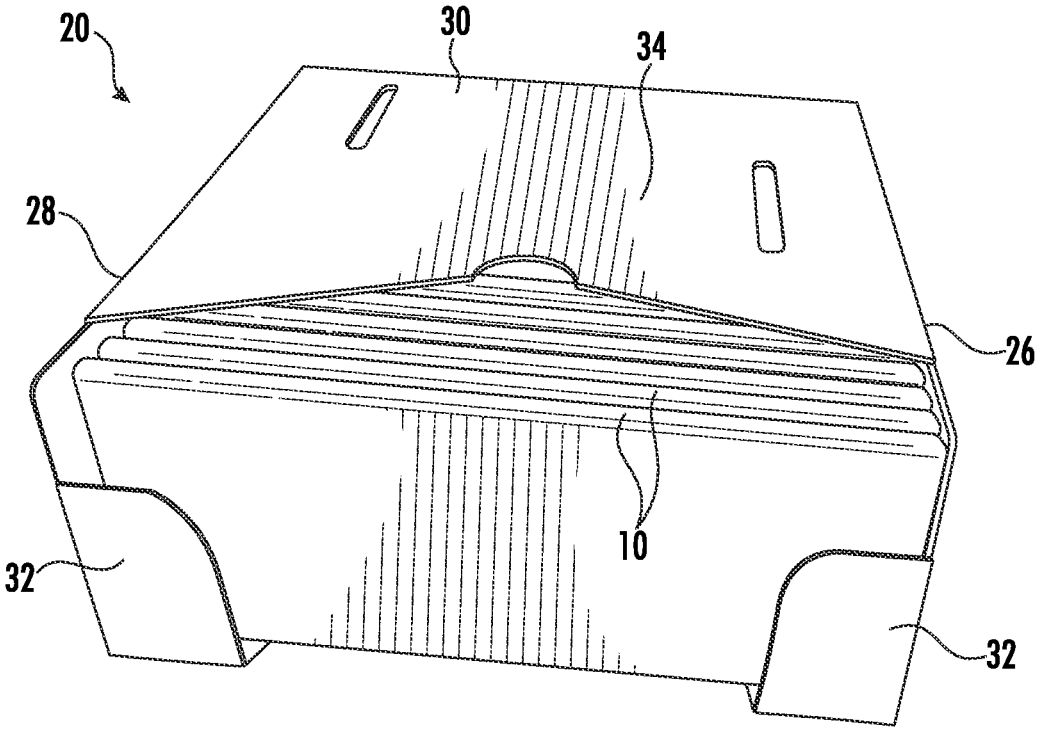
FIG. 1 is a perspective view of a shelf ready pack containing a plurality of items according to an embodiment.
Figure 2:
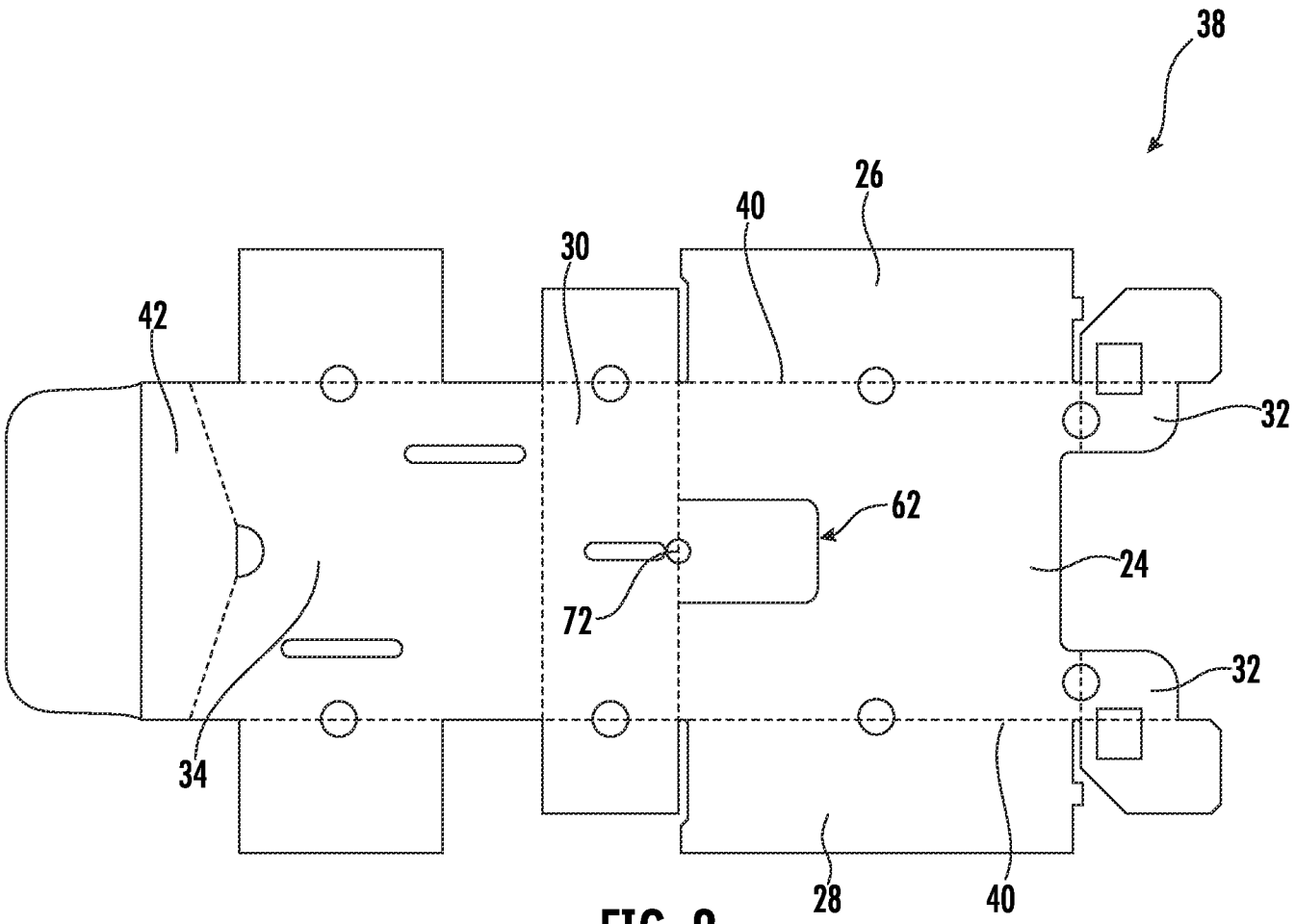
FIG. 2 is a schematic diagram of a flat piece of material configured to be folded into a shelf ready pack according to an embodiment.
Figure 3:
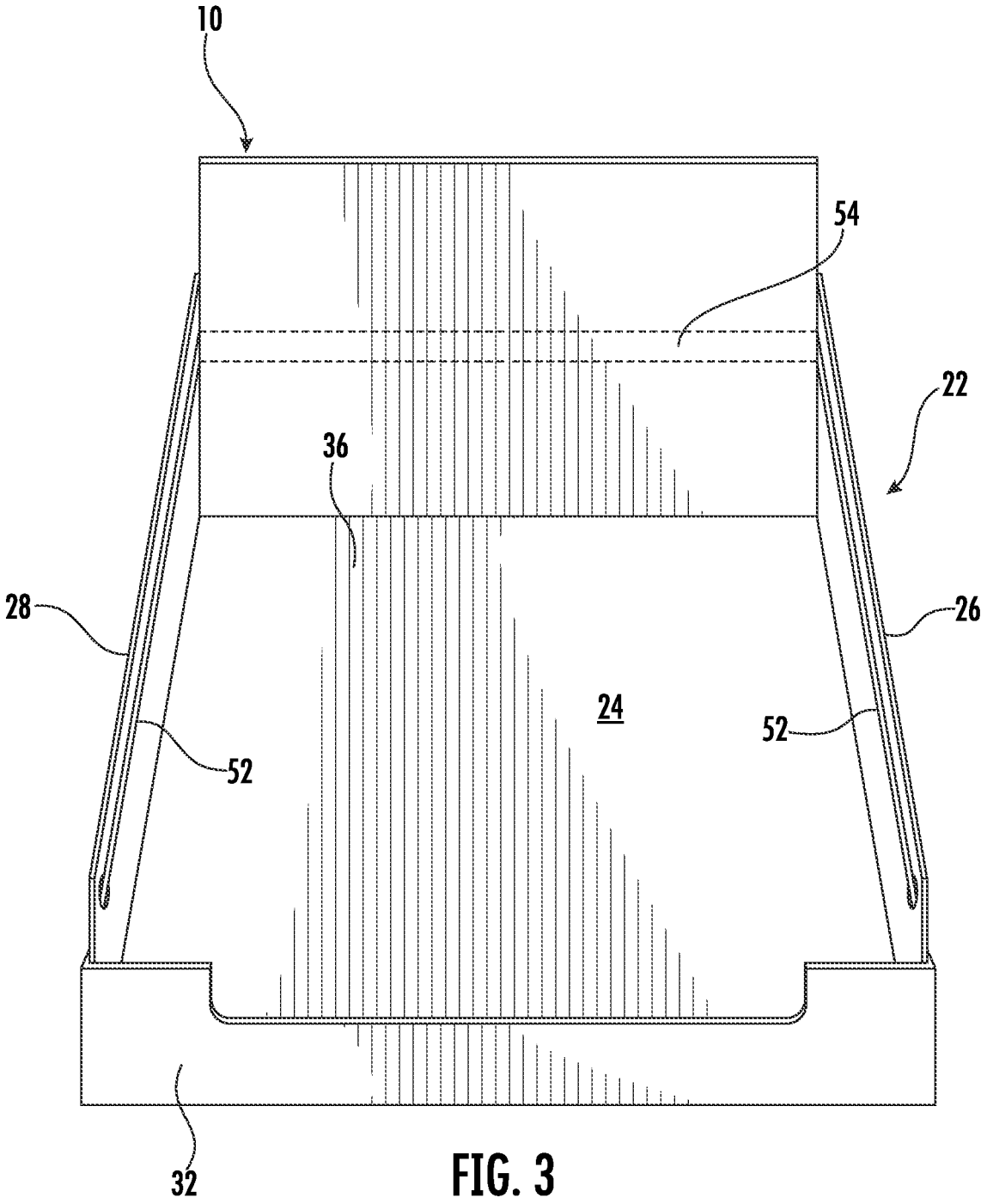
FIG. 3 is a front perspective view of a carton including a pusher according to an embodiment.
Figure 4:
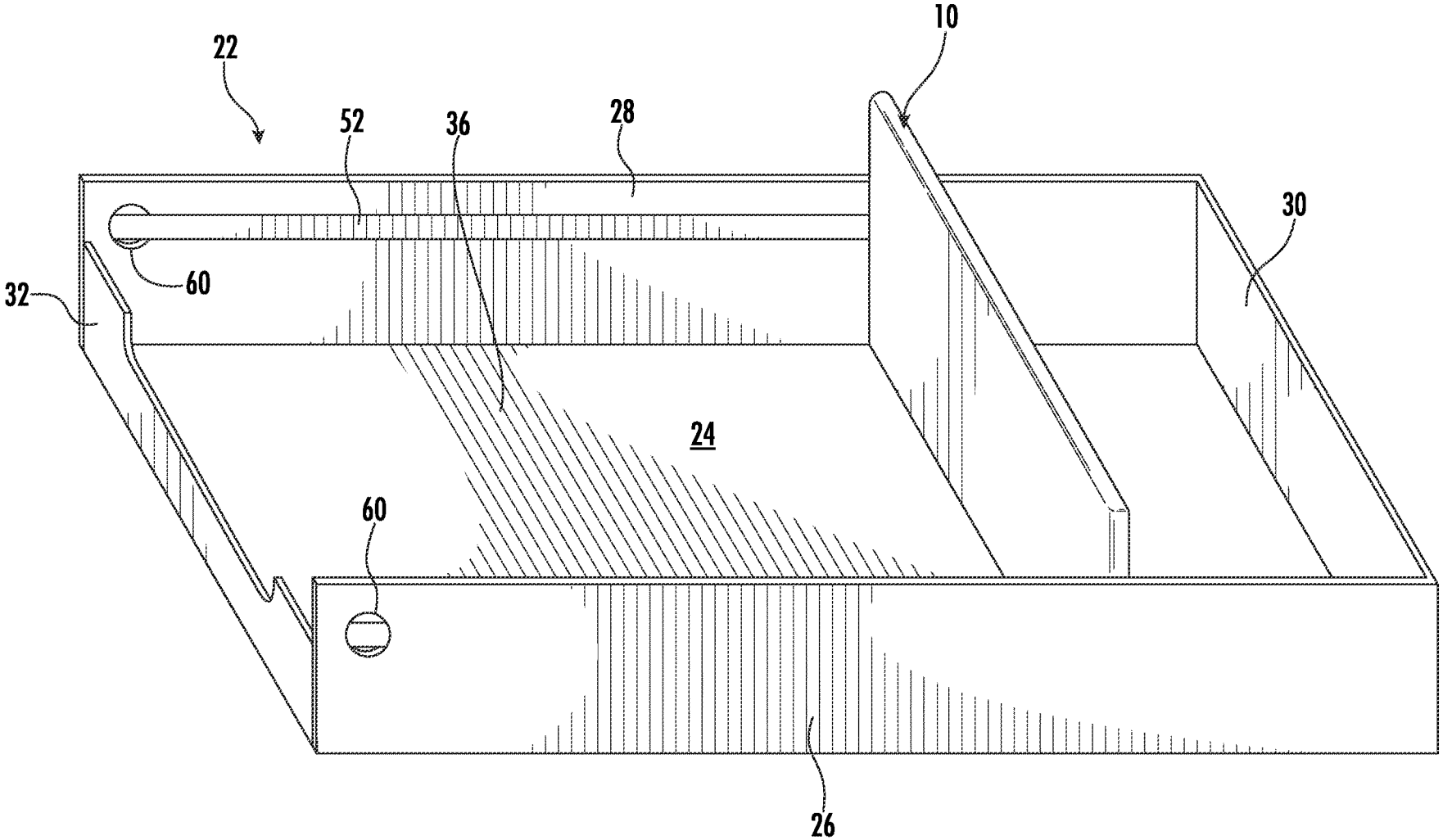
FIG. 4 is a perspective side view of the carton of FIG. 3 according to an embodiment.

The detailed description explains embodiments of the invention, together with advantages and features, by way of example with reference to the drawings.

DETAILED DESCRIPTION OF THE INVENTION

A pusher will be described below for use with a container in the form of a cardboard carton which is a shelf ready pack. However, it should be understood that the pusher can be used in a wide variety of other applications in different formats including different materials.

In the following, the related expressions top and bottom, upper and lower, front and rear, inner and outer, upward and downward, and derivatives thereof are used to refer to the completed carton and parts thereof when the carton is in its intended orientation, for placing on a shelf or other display surface. However, the carton may be used and stored in other orientations as desired.

Referring now to FIGS. 1-7, an example of a shelf ready pack or package 20 is illustrated. As shown, the shelf ready pack 20 includes a carton 22 having a bottom panel 24, two side panels 26, 28, a back panel 30, and an at least partial front panel 32, all extending upwardly from the bottom panel 24. However, not all of these panels, in particular the side panels 26, 28 and back panel 30, are necessary for operation of the pack 20. In the illustrated, non-limiting embodiment, the carton 22 additionally includes a lid 34, arranged generally parallel to and opposite the bottom panel 24, and extending between the two side panels 26, 28, the back panel 30 and the front panel 32. Configurations of the carton 22 that do not include a lid 34, or include only a partial lid 34, are also considered within the scope of the disclosure.

A cavity 36 for storing multiple products 10, stacked in either a vertical or horizontal configuration, is defined between the front panel 32, back panel 30, and side panels 26, 28 of the carton 22. Typically, each of the plurality of products 10 within the cavity 36 is substantially identical, but embodiments where different products are contained within the cavity 36 are also contemplated. In an embodiment, at least one dimension of the cavity 36, such as the distance between the opposing side panels 26, 28 for example, is substantially identical or slightly larger than a dimension of a product 10 housed within the cavity 36. In addition, another dimension of the cavity 36, such as the distance between the front panel 32 and the back panel 30 for example, may be selected based on a predefined quantity of the one or more products 10 to be housed within the cavity 36.

The carton 22 may be made of any suitable material, a common material for such cartons being cardboard. In an embodiment, best shown in FIG. 2, the carton 22 is formed from a single piece of material 38, by folding various portions of the material 38 along fold lines 40, illustrated schematically as broken or dotted lines in the FIG. A portion 42 of the lid 34 adjacent to and/or overlapping with the front panel 32 may be perforated for easy detachment from the remainder of the carton 22. During transport and shipment, this removable portion 42 is configured to protect the contents of the carton 22. When the carton 22 is positioned on a shelf for display, as shown in FIG. 1, the portion 42 is removed to provide a consumer with access to the contents contained within the interior cavity 36 of the carton 22.

The package 20 additionally includes a pusher comprising a resilient member 50, for example an elastic band, configured to apply a force to the products 10 within the carton 22 so that the contents are always arranged directly adjacent to or in contact with the front panel 32. As shown, the resilient member 50 is configured as a ring or loop which passes behind the rearmost product 10 within the cavity 36. As a result, a portion 52 of the resilient member 50 extends along the side panels 26, 28 and another portion 54 of the resilient member 50 is oriented generally parallel to the back panel 30. In an embodiment, as shown in FIG., the open or free ends of the resilient member 50 are secured to the side panels 26, 28 of the carton 22 via apertures 60. However, the resilient member 50 may be secured to any other suitable area of the carton 22, such as the front panel 32 for example, such that the resilient member 50 is biased towards the front panel 32.

In embodiments where the product 10 is an edible composition, such as chocolate for example, direct contact between the resilient member 50 and the rearmost product 10 within the cavity 36 may damage one or more products 10 within the carton 22 due to the strength of the biasing force. To reduce the force directly applied to the products 10, an intermediate member 62 is removably arranged at a position behind the items 10 to be dispensed, between the rearmost product 10 and the resilient member 50.

Figure 6:
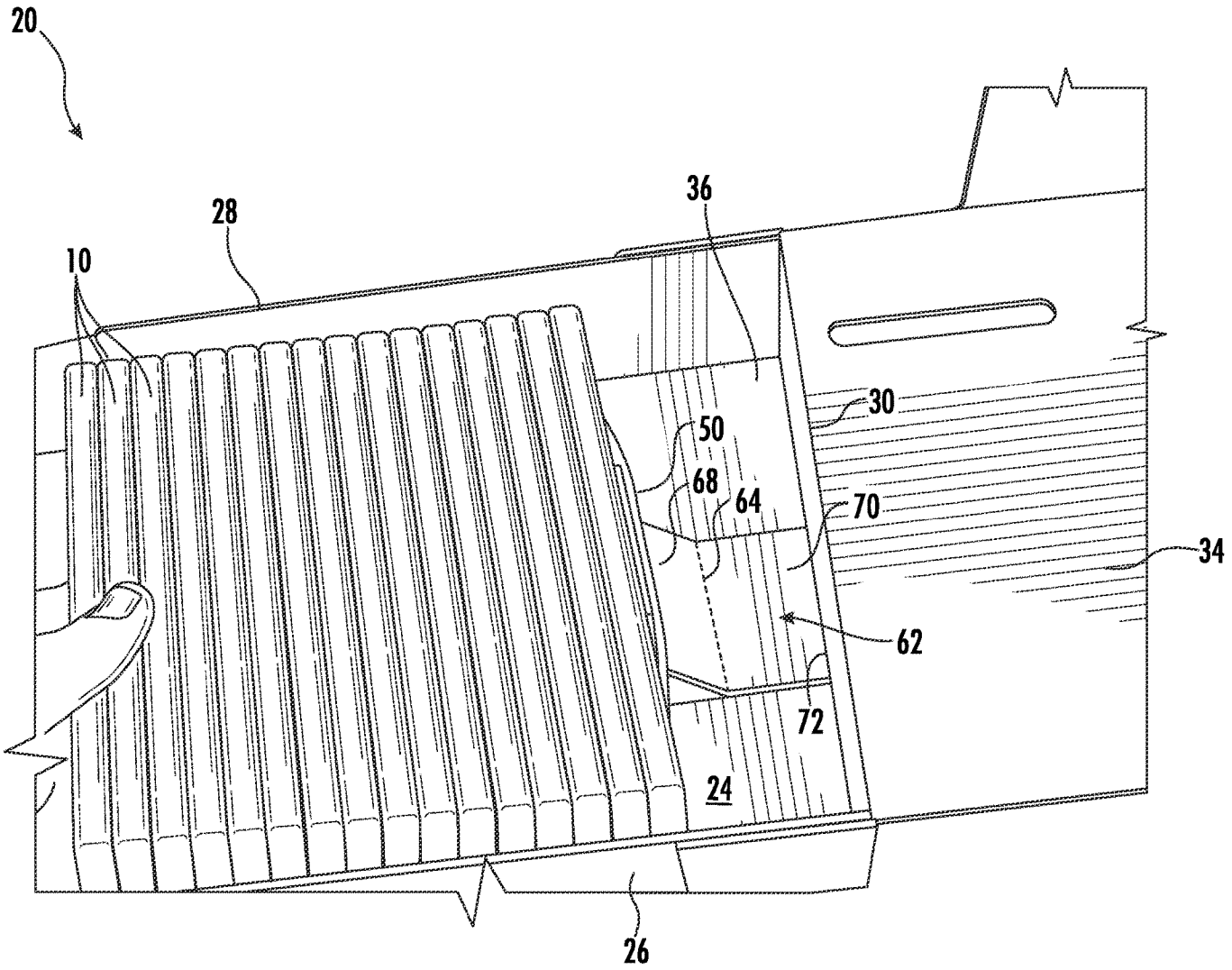
FIG. 6 is a perspective view of the shelf ready pack of FIG. 5 having a pusher arranged at a second position according to an embodiment.
Figure 7:
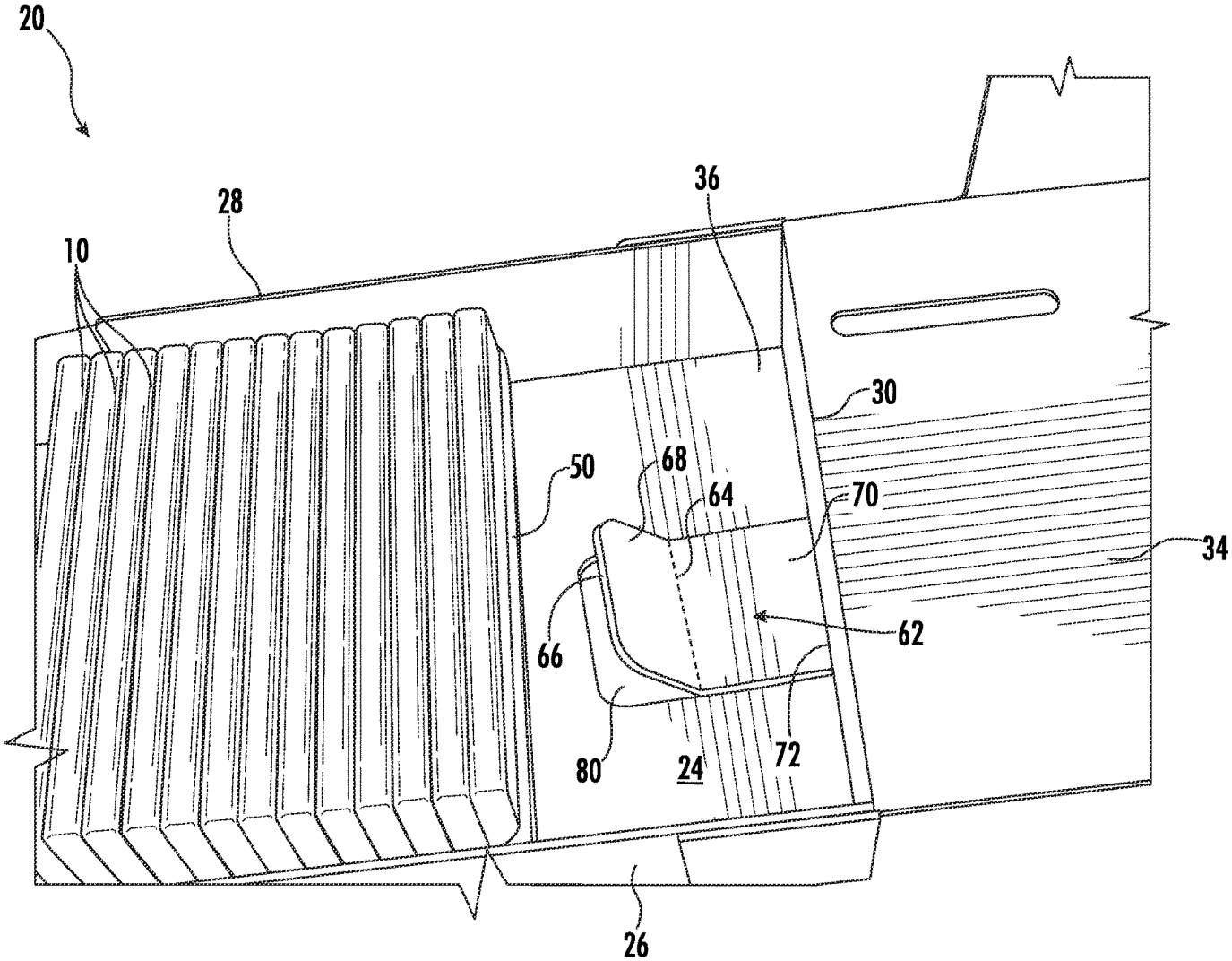
FIG. 7 is a perspective view of a shelf ready pack of FIG. 5 having a pusher arranged at a second position according to an embodiment.

In the illustrated, non-limiting embodiments, the intermediate member 62 is generally rectangular in shape. However, an intermediate member 62 having another shape or contour may also be used. The intermediate member 62 may optionally include a generally transverse fold line 64 positioned at a central location and extending across a width of the intermediate member 62 as shown in FIGS. 6 and 7. In an embodiment, the fold line 64 is arranged between a center of the intermediate member 62 and the end 66 of the intermediate member 62 closest to the front panel 32. The fold line 64 defines a contact section 68 and a base section 70 of the intermediate member 62.

A portion of the intermediate member 62, such as an end 72 of the base section 70 for example, is fixed related to the carton 22. In an embodiment, the intermediate member 62 is formed as a portion of the single piece of material 38 used to create the carton 22. In such embodiments, the end 72 of the base section 70 is integrally formed with at least one of the bottom panel 24 and the back panel 30 of the carton 22. However, embodiments where the intermediate member 62 is a separate component coupled to the carton 22 are also within the scope of the disclosure.

The intermediate member 62 is configured to rotate about end 72 relative the carton 22. In embodiments where the intermediate member 62 is integrally formed with the carton 22, at least a portion of the periphery of the intermediate member 62 is perforated to allow such movement. The contact section 68 is also configured to rotate relative to the base section 70 about the fold line 64.

The contact section 68 of the intermediate member 62 is configured to removably or selectively contact a back surface of the rearmost product 10, between the product 10 and the resilient member 50. In an embodiment, the contact section 68 is arranged in contact with the product 10 when the rearmost product is located at any distance from the back panel 30 that is less than the length of the intermediate member 62, such as demonstrated by the opening 80 formed in the bottom panel 24 (see FIG. 7). When in contact, the contact section 68 of the intermediate member 62 is positioned between the rearmost product 10 and the resilient member 50 such that the biasing force of the resilient member 50 maintains the engagement between the contact section 68 and the rearmost product 10.

Figure 5:
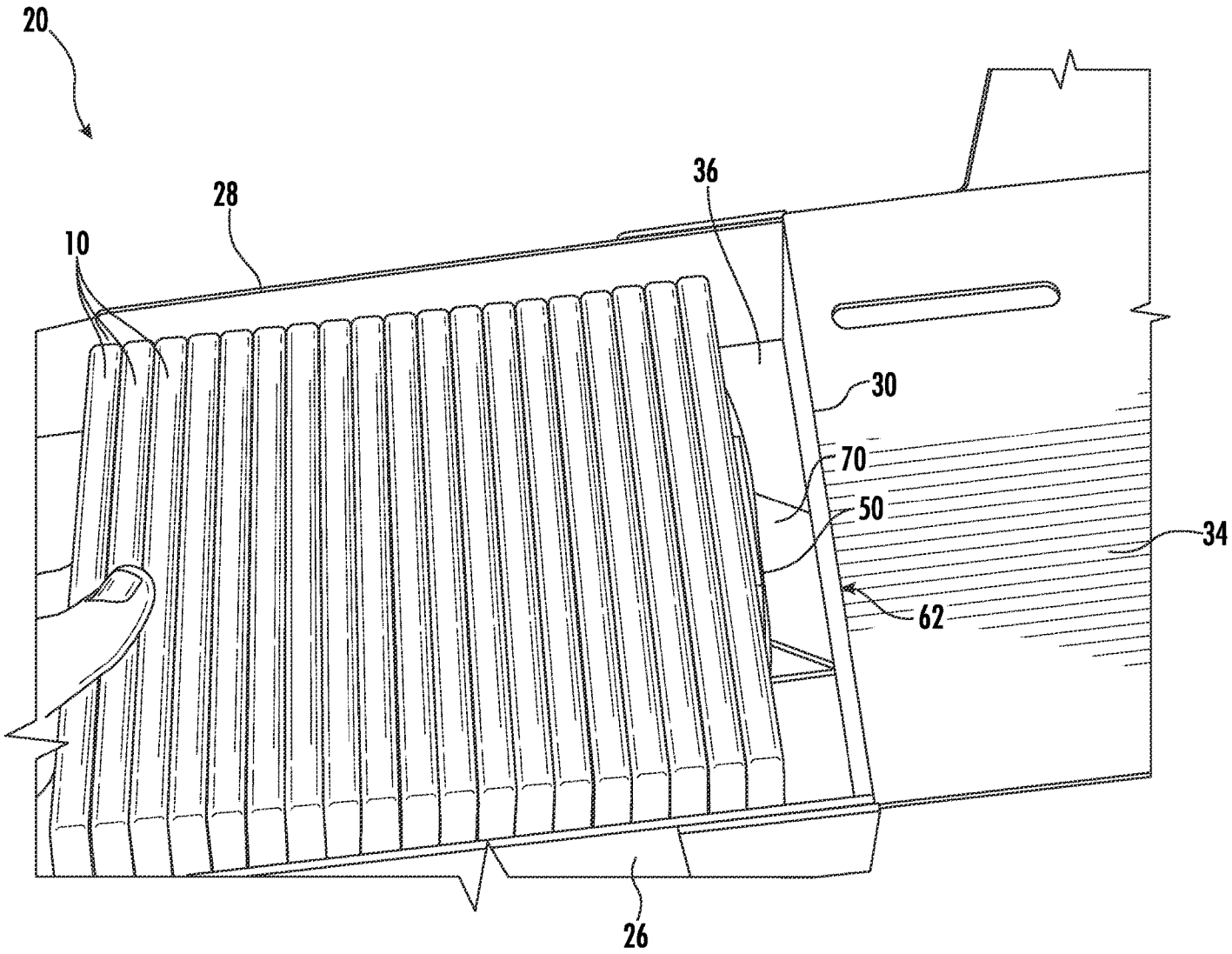
FIG. 5 is a perspective view of a shelf ready pack having a pusher arranged at a first position according to an embodiment.

The intermediate member 62 rotates about end 72, and in embodiments including the fold line 64, the contact section 68 of the intermediate member 62 rotates about the fold line 64 to maintain engagement between the contact section 68 and the rearmost product 10 as product is removed from the cavity 36. As shown in FIG. 5, when the carton 22 contains a desired number of products 10 and is considered "full", the base section 70 of the intermediate member 62 is arranged at a position rotated upwardly into the cavity 36. As products 10 are removed from adjacent the front panel 32 of the carton 22, the biasing force of the resilient member 50 causes the remaining products 10 to slide towards the front panel 32. As the biasing force moves the products 10 forward within the cavity 36, the intermediate member 62 will begin to rotate about end 72 toward a position where the base section 70 is generally parallel to the bottom panel 24 (FIG. 6). As the intermediate member 62 rotates about end 72, the contact section 68 maintains contact with the product 10. As additional products 10 are removed from the carton 22 and biased towards the front panel 32, a portion of the intermediate member 62 may fold about the fold line 64, gradually reducing the contact area between the contact section 68 and the rearmost product 10.

As the rearmost product 10 slides to a position that is separated from the back panel 30 by a distance greater than the overall length of the intermediate member 62, the contact section 68 will separate from the product 10, such that portion 54 of the resilient member 50 is in direct contact with the rearmost product 10. The size of the intermediate member 62 may be selected such that the resilient member 50 is configured to directly engage the product 10 after the removal of a desired number of products 10, and at a position where the biasing force of the resilient member 50 is insufficient to damage the product 10.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

What is claimed is:

1. A package for displaying items, the package comprising:

a carton body having at least a bottom panel, a front panel, and a back panel;

a resilient member configured to urge the items towards said front panel of said carton body; and an intermediate member extending from at least one of said bottom panel, said back panel, and a junction between said bottom panel and said back panel and, in use, removably positioned between said resilient member and the items, wherein said intermediate member is rotatable out of engagement with the items as the items are removed from said carton body.

2. The package according to claim 1, wherein said intermediate member is removed from said position between said resilient member and the items after the items move towards said front panel of said carton body via removal of a desirable number of items from the package.

3. The package according to claim 1, wherein said position between said resilient member and the items is located at a rearmost of the items.

4. The package according to claim 1, wherein said intermediate member is connected to said carton body.

5. The package according to claim 4, wherein said intermediate member extends from said bottom panel of said carton body.

6. The package according to claim 1, wherein a fold axis extends across a central portion of said intermediate member, said fold axis defining a contact section and a base section of said intermediate member.

7. The package according to claim 6, wherein when said intermediate member is positioned between said resilient member and the items, said contact section is arranged in contact with the items.

8. The package according to claim 6, wherein as the items are removed from the package, a contact area between said contact section of said intermediate member and the items is reduced.

9. The package according to claim 1, wherein said intermediate member is integrally formed with said carton body.

10. The package according to claim 1, wherein said resilient member is a loop secured at an open end to said front panel and configured to extend around the items.

11. The package according to claim 1, wherein said carton body includes side panels, and said resilient member is a loop secured at an open end to said side panels and configured to extend around the items.

12. The package according to claim 1, wherein said resilient member is an elastic band.

13. A packaging system comprising:

a package having at least a bottom panel, a front panel, and a back panel;

a plurality of items disposed in said package;

a resilient member configured to urge said plurality of items towards said front panel of said package; and an intermediate member extending from at least one of said bottom panel, said back panel, and a junction between said bottom panel and said back panel and, in use, removably positioned between said resilient member and said plurality of items, wherein said intermediate member is rotatable out of engagement with said plurality of items as said plurality of items are removed from said package.

14. The packaging system according to claim 13, wherein said plurality of items is horizontally stacked.

15. The packaging system according to claim 13, wherein said plurality of items is vertically stacked.

* * * * *